US009972241B2

(12) United States Patent
Tsuge

(10) Patent No.: US 9,972,241 B2
(45) Date of Patent: May 15, 2018

(54) DISPLAY DEVICE

(71) Applicant: JOLED INC., Tokyo (JP)

(72) Inventor: Hitoshi Tsuge, Tokyo (JP)

(73) Assignee: JOLED INC., Tokyo (JP)

( * ) Notice: Subject to any disclaimer, the term of this patent is extended or adjusted under 35 U.S.C. 154(b) by 45 days.

(21) Appl. No.: 14/942,028

(22) Filed: Nov. 16, 2015

(65) Prior Publication Data

US 2016/0148563 A1 May 26, 2016

(30) Foreign Application Priority Data

Nov. 21, 2014 (JP) ..... 2014-236597

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0861* (2013.01); *G09G 2310/0251* (2013.01); *G09G 2310/0262* (2013.01)

(58) Field of Classification Search
None
See application file for complete search history.

(56) References Cited

U.S. PATENT DOCUMENTS 8,765,494 B2 7/2014 Hiraoka et al.
8,830,215 B2 9/2014 Ono et al.
2008/0088546 A1* 4/2008 Takasugi ..... G09G 3/3233 345/76
2009/0153448 A1* 6/2009 Tomida ..... G09G 3/3233 345/82
2010/0033477 A1* 2/2010 Yamashita ..... G09G 3/3233 345/215
2010/0033511 A1* 2/2010 Yamashita ..... G09G 3/3233 345/690
2010/0079430 A1* 4/2010 Yamashita ..... G09G 3/3233 345/210

(Continued)

FOREIGN PATENT DOCUMENTS

JP 2012-189828 10/2012
WO 2013/021417 2/2013

OTHER PUBLICATIONS

Office Action from Japan Patent Office (JPO) in Japanese Patent Appl. No. 2014-236597, dated Feb. 27, 2018.

*Primary Examiner* — David D Davis
(74) *Attorney, Agent, or Firm* — Greenblum & Bernstein, P.L.C.

(57) ABSTRACT

A display device includes: a pixel region in which plural pixels, each including a light emitting element, a capacitor, a drive transistor, and a switch transistor, are arranged in rows and columns; scanning lines; signal lines; and parasitic capacitance which occurs between a source node of the light emitting element of each of the plural pixels and a signal line among the signal lines, wherein when images having different grayscales are displayed in the pixels on adjacent rows which are a 1st-row pixel and a 2nd-row pixel, a difference between a gate-source voltage of the drive transistor of the 1st-row pixel and a gate-source voltage of the drive transistor of the 2nd-row pixel is less than a voltage value of one grayscale, the difference being represented by ΔVdata×Cad/(Cs+Cad+Coled).

8 Claims, 17 Drawing Sheets

(56) References Cited

U.S. PATENT DOCUMENTS

| | | | |
|---|---|---|---|
| 2012/0229438 | A1 | 9/2012 | Fujita |
| 2013/0038596 | A1 | 2/2013 | Ono et al. |
| 2017/0004767 | A1 | 1/2017 | Fujita |

* cited by examiner

DISPLAY DEVICE

CROSS REFERENCE TO RELATED APPLICATIONS

The present application is based on and claims priority of Japanese Patent Application No. 2014-236597 filed on Nov. 21, 2014. The entire disclosure of the above-identified application, including the specification, drawings and claims is incorporated herein by reference in its entirety.

FIELD

The present disclosure relates to a display device which includes organic electro-luminescence (Hereinafter, also referred to as an EL or an OLED.) elements.

BACKGROUND

In recent years, organic EL display devices using organic electro-luminescence elements are drawing attention as display devices. An organic EL element includes, on a glass substrate, an anode-side conductive layer, organic layers including a light-emissive layer, and a cathode-side conductive layer.

Organic EL display devices are recently demanded to have an increased screen size and an increased resolution. For organic EL elements included in a large screen, the time constant for scanning lines is set great. For high resolution organic EL elements, the write time is set short. Thus, a voltage less than a set write voltage is applied to a pixel, and consequently, an image having a desired luminance may not be displayed.

Thus, for a panel where the time constant for scanning lines is great and the write time is short, a technology is disclosed in which prior to writing an image signal (a Data voltage) to a pixel, a scanning line is placed in the on-state, that is, a high signal voltage is applied to the scanning line and a path though which the image signal is taken into the pixel is ensured, and then a voltage according to the image signal is input to the pixel (e.g., see Patent Literature (PTL) 1).

CITATION LIST

Patent Literature

[PTL 1] International Publication WO2013/021417

SUMMARY

Technical Problem

However, if parasitic capacitance is present between a signal line and an anode node of an organic EL element, a voltage to be written to the pixel depends on whether the Data voltage varies or not when the scanning line is in the on-state. For example, in order to display a window pattern in white at the center of a black screen, Data voltages according to black display are applied to pixels on the 0th row of the window pattern, that is, one row followed by the 1st row which starts the display of the window pattern, and Data voltages according to white display are applied to pixels on the 1st and the subsequent rows. In this case, on the 1st row, the values of the Data voltage vary from the value of the Data voltage according to black display to the value of the Data voltage according to white display. At this time, the 1st row of the window pattern is not displayed at a normal luminance, causing a problem that the luminance of the window pattern on the 1st row is different from those on the 2nd and the following rows.

In light of the above problem, an object of the present disclosure is to provide a display device which can display an image at a normal luminance even for a large screen and a high resolution screen.

Solution to Problem

To address the above problem, a display device according to one aspect of the present disclosure is a display device including: a pixel region in which plural pixels, each including a light emitting element, a capacitor, a drive transistor, and a switch transistor, are arranged in rows and columns; scanning lines which supply the switch transistors with control signals for controlling an on-state and an off-state of the switch transistors; signal lines which supply the plural pixels with image signals for causing the light emitting elements to emit light having desired luminances; and parasitic capacitance which occurs between a source node of the light emitting element of each of the plural pixels and a signal line among the signal lines, wherein a 0th-row pixel, a 1st-row pixel, and a 2nd-row pixel included in the plural pixels are connected to the signal line and supplied with a first image signal, a second image signal different from the first image signal, and the second image signal, respectively, and a difference between a gate-source voltage of the drive transistor of the 1st-row pixel and a gate-source voltage of the drive transistor of the 2nd-row pixel is less than a voltage value of one grayscale, the difference being represented by: $\Delta Vdata \times Cad/(Cs+Cad+Coled)$ where $\Delta Vdata$ denotes a difference between the first image signal supplied to the 0th-row pixel and the second image signal supplied to the 1st-row pixel, Cs denotes capacitance of the capacitor, Cad denotes the parasitic capacitance, and Coled denotes capacitance of the light emitting element.

Advantageous Effects

According to the display device of the present disclosure, a display device which can display an image at a normal luminance even for a large screen and a high resolution screen can be provided.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 6 is a circuit diagram for illustrating operation of the pixel circuit before a Data voltage is written to.

DESCRIPTION OF EMBODIMENTS

Figure 1:
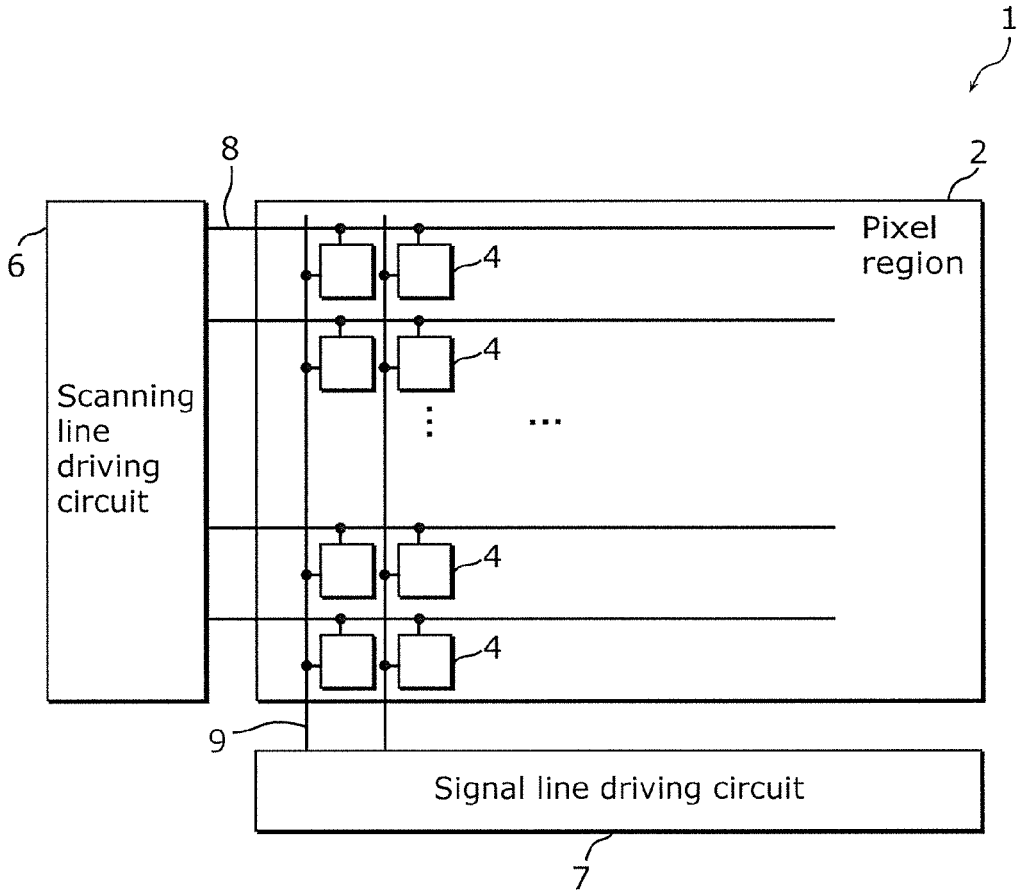
FIG. 1 is a schematic view of a configuration of a display device according to Embodiment 1.

To address such a problem, a display device according to one aspect of the present disclosure is a display device including: a pixel region in which plural pixels, each including a light emitting element, a capacitor, a drive transistor, and a switch transistor, are arranged in rows and columns; scanning lines which supply the switch transistors with control signals for controlling an on-state and an off-state of the switch transistors; signal lines which supply the plural pixels with image signals for causing the light emitting elements to emit light having desired luminances; and parasitic capacitance which occurs between a source node of the light emitting element of each of the plural pixels and a signal line among the signal lines, wherein a 0th-row pixel, a 1st-row pixel, and a 2nd-row pixel included in the plural pixels are connected to the signal line and supplied with a first image signal, a second image signal different from the first image signal, and the second image signal, respectively, and a difference between a gate-source voltage of the drive transistor of the 1st-row pixel and a gate-source voltage of the drive transistor of the 2nd-row pixel is less than a voltage value of one grayscale, the difference being represented by: $\Delta Vdata \times Cad/(Cs+Cad+Coled)$ where $\Delta Vdata$ denotes a difference between the first image signal supplied to the 0th-row pixel and the second image signal supplied to the 1st-row pixel, Cs denotes capacitance of the capacitor, Cad denotes the parasitic capacitance, and Coled denotes capacitance of the light emitting element.

According to the above configuration, by setting the value of $\Delta Vdata \times Cad/(Cs+Cad+Coled)$ less than the voltage value of one grayscale, images are displayed at normal luminances in pixels on adjacent rows, even if the images have different grayscales.

Moreover, the difference between the gate-source voltage of the drive transistor of the 1st-row pixel and the gate-source voltage of the drive transistor of the 2nd-row pixel may be less than 5 mV.

According to the above configuration, in a display device which displays images at 1024 grayscale levels, where a voltage applied to a signal line changes in a range from at least 0 V to at least 5 V, the voltage may be set to change each by a voltage value less than a voltage according to luminance change by one grayscale level. Thus, even the display device which displays images at 1024 grayscale levels can display them at normal luminances in pixels on adjacent rows, even if they have different grayscales.

Moreover, anode electrodes of the light emitting elements and the signal lines may be disposed not overlapping one another when the plural pixels are viewed in plan.

According to the above configuration, disposing the signal lines and the anode electrodes so as not to overlap one another when viewed in plan can achieve a reduced magnitude of the capacitance Cad of the parasitic capacitance. This allows the value of $\Delta Vdata \times Cad/(Cs+Cad+Coled)$ to be set to a small value. Thus, images are displayed at normal luminances in pixels on adjacent rows even if the images have different grayscales.

Moreover, a conductive layer may be disposed between anode electrodes of the light emitting elements and the signal lines.

According to the above configuration, the conductive layer disposed between the anode electrodes and the signal lines prevents the anode electrodes from the effect of changes of Data voltages applied to the signal lines. Thus, images are displayed at normal luminances in pixels on adjacent rows even if the images have different grayscales.

Hereinafter, embodiments according to the present disclosure are to be described in detail, with reference to the accompanying drawings. The embodiments described below are each general and specific illustration of the present disclosure. Values, shapes, materials, components, and arrangement and connection between the components shown in the following embodiments are merely illustrative and not intended to limit the present disclosure. Among the components in the embodiments below, components not recited in any one of the independent claims of the present disclosure are described as arbitrary components. The figures do not necessarily show precise sizes and scale ratios, etc.

Embodiment 1

[1. Configuration of Display Device]

FIG. 1 is a schematic view of a configuration of a display device 1 according to the present embodiment.

As shown in FIG. 1, the display device 1 includes a pixel region 2, a scanning line driving circuit 6, and a signal line driving circuit 7. The pixel region 2 has a plurality of pixels 4 arranged in rows and columns.

The pixel 4 are each electrically connected to the scanning line driving circuit 6 via one of scanning lines 8, and electrically connected to the signal line driving circuit 7 via one of signal lines 9. Configuration of the pixels 4 is described in detail below.

The signal line driving circuit 7 outputs an image signal Data according to a display image to each pixel 4 via the signal line 9. The scanning line driving circuit 6 outputs a scanning signal Scan to each pixel 4 via the scanning line 8. The scanning signal Scan transfers the image signal Data to the pixel 4. This allows the pixel 4 to display an image according to the image signal Data.

[2. Pixel Configuration]

Figure 2:
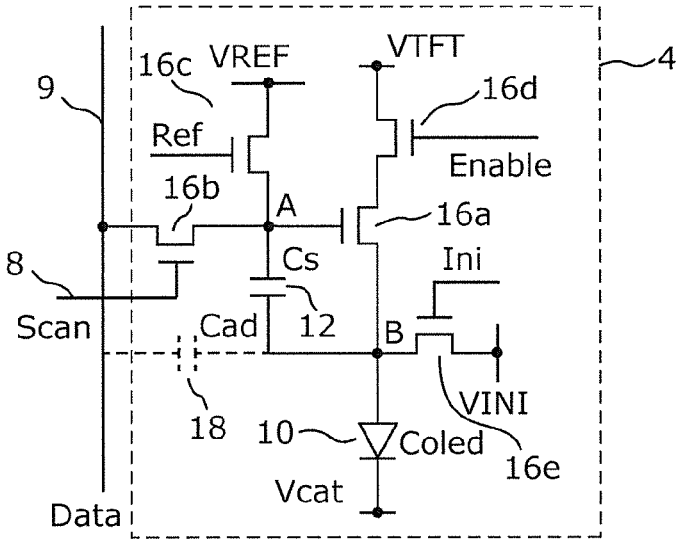
FIG. 2 is a circuit diagram showing an example of a configuration of pixels according to Embodiment 1.

Next, a configuration of the pixels 4 according to the present embodiment is described. FIG. 2 is a circuit diagram showing an example of a configuration of the pixels 4 according to the present embodiment.

The pixels 4, as shown in FIG. 2, each include a light emitting element 10, a capacitor 12, a drive transistor 16*a*, and transistors 16*b*, 16*c*, 16*d*, and 16*e*. The light emitting element 10 is, for example, an organic EL element. The drive transistor 16*a* and the transistors 16*b* to 16*e* are n-type transistors. The transistor 16*b* corresponds to a switch transistor according to the present disclosure. The configuration of the pixels 4 is not limited to the configuration shown in FIG. 2, and may be any other configuration.

If the scanning signal Scan is supplied from the scanning line 8 to the pixel 4, charge according to the image signal Data from the signal line 9 is stored into the capacitor 12. Then, a voltage according to the charge stored in the capacitor 12 is applied between the gate and the source of the drive transistor 16*a*, in response to which a current according to the image signal Data flows through the light emitting element 10, and the light emitting element 10 emits light having a luminance according to the image signal Data.

In response to the application of the voltage according to the image signal Data between the gate and the source, the drive transistor 16*a* supplies the light emitting element 10 with the current according to the image signal Data. The transistors 16*b*, 16*c*, 16*d*, and 16*e* transition between the conductive state and the non-conductive state, in response to application of a voltage which is independent of the image signal Data between the gate and the source. The drive transistor 16*a* and the transistors 16*b* to 16*e* may be formed of amorphous silicon, poly silicon, or a transparent amorphous oxide semiconductor (TAOS).

The display device 1 includes the signal lines 9 and the pixels 4 disposed on the substrate. The light emitting element 10 in each pixel 4 is an organic EL element which has a layered structure in which an anode electrode 10*a*, a hole injection layer, a hole transport layer, a light-emissive layer, an organic functional layer, and a cathode-side conductive layer are stacked in the listed order on the substrate having a TFT circuit formed thereon, via an interlayer insulating layer. The plurality of pixels 4 included in the display device 1 share the substrate, the interlayer insulating layer, and the TFT circuit.

Figure 3:
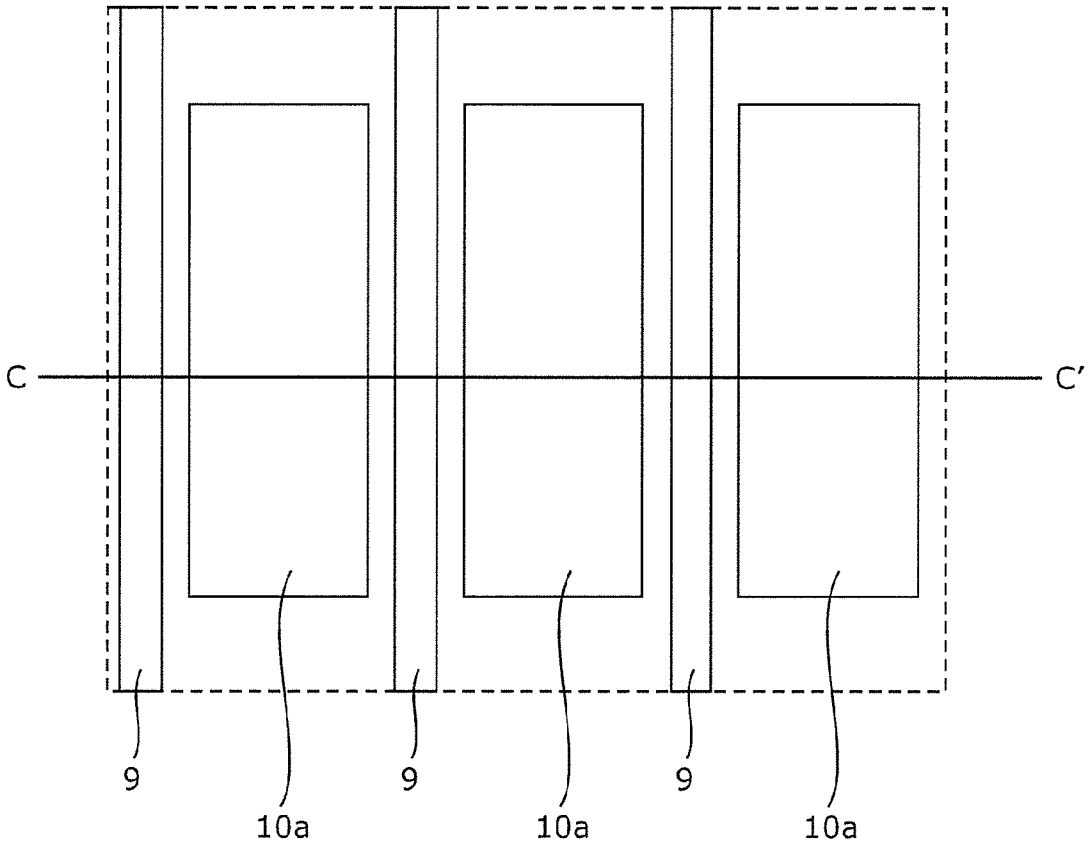
FIG. 3 is a top view showing the positional relationship of a signal line and an anode of a light emitting element according to Embodiment 1.
Figure 4:
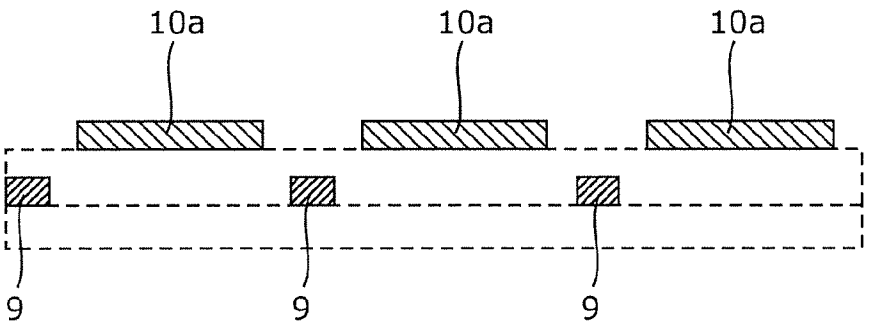
FIG. 4 is a sectional view, taken along CC' in FIG. 3.

Here, the positional relationship of the signal line 9 and the anode electrode 10*a* of the light emitting element 10 is described. FIG. 3 is a top view showing the positional relationship of the signal line 9 and the anode electrode 10*a* of the light emitting element 10 according to the present embodiment. FIG. 4 is a sectional view, taken along CC in FIG. 3. It should be noted that configuration of components other than that of the signal line 9 and the anode electrode 10*a* of the light emitting element 10 are not shown in FIGS. 3 and 4.

The display device 1 has a so-called top emission structure according to which the top side in FIG. 4 is a display surface. It should be noted that the display device 1 may have a so-called bottom emission structure.

As shown in FIGS. 3 and 4, the signal line 9 and the anode electrode 10*a* of the light emitting element 10 are disposed in a manner that they do not overlap one another when the pixel 4 is viewed in plan. In addition, as shown in FIG. 4, the anode electrode 10*a* and the signal line 9 are disposed in two different layers.

According to this configuration, parasitic capacitance 18 occurs between the anode electrode 10*a* and the signal line 9, as shown in FIG. 2. Relationship of the positional relationship of the anode electrode 10*a* and the signal line 9 versus the magnitude of the parasitic capacitance 18 is described in detail below.

[3. Operation of Display Device]

Figure 5:
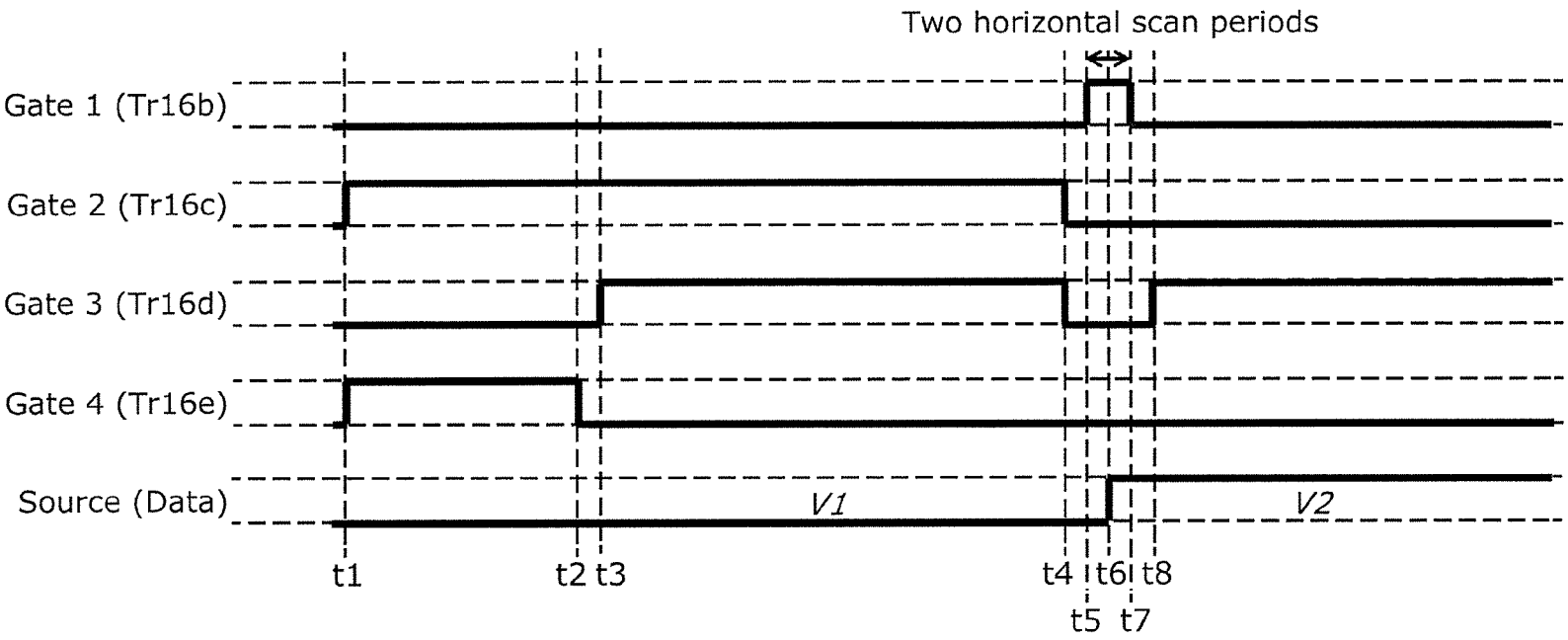
FIG. 5 is a timing diagram illustrating operation of a pixel circuit.

Next, operation of the display device 1 according to the present embodiment is described. FIG. 5 is a timing diagram illustrating operation of a pixel circuit.

When the scanning signal Scan is supplied from the scanning line 8 to the pixel 4, a Data voltage, which is the voltage according to the image signal Data, is applied between the gate and the source of the drive transistor 16*a* from the signal line 9, in response to which the current according to the image signal Data flows through the light emitting element 10, and the light emitting element 10 emits light having a luminance according to the image signal Data.

More specifically, in the pixel 4, a reference-voltage supply line VREF, an EL-anode voltage supply line VTFT, an EL-cathode voltage supply line Vcat, an initialization voltage supply line VINI, a reference-voltage control line Ref, an initialization control line Ini, and an enable line Enable are interconnected. The EL-anode voltage supply line VTFT is connected to an anode-voltage generating circuit (not shown) which supplies the light emitting element 10 with the pixel current according to the image signal Data. The EL-cathode voltage supply line Vcat is connected to a cathode-voltage generating circuit (not shown) which generates a cathode voltage to be applied to the light emitting element 10. It should be noted that the EL-cathode voltage supply line Vcat may be grounded to GND of the anode-voltage generating circuit, rather than being connected to the cathode-voltage generating circuit. The initialization voltage supply line VINI is connected to a VINI voltage generating circuit (not shown) which generates an initialization voltage VINI used to initialize the capacitor 12.

As shown in FIG. 5, at predetermined timings, signals the respective voltage levels of which are HIGH and LOW are supplied to the scanning line 8 to which the scanning signal Scan is supplied, the reference-voltage control line Ref, the initialization control line Ini, and the enable line Enable. Since the drive transistor 16*a* and the transistors 16*b* to 16*e* included in the pixel 4 are n-type transistors, the transistor is placed in the on-state if the HIGH signal is supplied to the gate, and the transistor is placed in the non-conductive state (off-state) if the LOW signal is supplied to the gate.

It should be noted that gates 1, 2, 3, and 4 in FIG. 5 indicate the respective gates of the transistors 16*b*, 16*c*, 16*d*, and 16*e*. Tr16*b*, Tr16*c*, Tr16*d*, and Tr16*e* respectively indicate the transistors 16*b*, 16*c*, 16*d*, and 16*e*.

In FIG. 5, a period from a time t1 to a time t8 is a non-emitting time period during which the pixel 4 emits no light, and a period after the time t8 is an emitting time period during which the pixel 4 emits light.

A period from the time t1 to the time t2 is a reset time period for resetting the charge stored in the capacitor 12. The reset time period is initiated by changing (raising) the voltage level of the initialization voltage VINI from LOW to HIGH.

A period from the time t2 to the time t3 is an initialization time period for initialization of the drive transistor 16*a*. The initialization time period is initiated by changing the voltage level of the initialization voltage VINI from HIGH to LOW, while keeping the voltage level of the reference-voltage control line Ref at HIGH. It should be noted that during the initialization time period, a voltage used to compensate a threshold voltage Vth of the drive transistor 16*a* is applied between the gate electrode and the source electrode of the drive transistor 16*a*.

A period from the time t3 to the time t4 is a threshold-voltage compensating time period for compensating the threshold voltage Vth of the drive transistor 16*a*. During the threshold-voltage compensating time period, the threshold voltage of the drive transistor 16*a* is compensated.

During a period from the time t4 to the time t5, the transistor 16*c* and the transistor 16*d* are simultaneously placed into the non-conductive state and thereby a connection point A is prevented from being simultaneously applied the Data voltage according to the image signal Data supplied via the signal line 9, and a reference voltage Vref of the reference-voltage supply line VREF.

A period from the time t5 to the time t7 is a writing time period during which an image signal voltage (a data signal voltage) according to a grayscale of display is taken from the signal line 9 into the circuit of the pixel 4 via the transistor 16*b*, and the image signal voltage is written to the capacitor 12. The transistor 16*b* is placed into the conductive state (the on-state) at the time t5. The image signal Data changes from a voltage V1 to a voltage V2 at the time t6. The transistor 16*b* is placed into the non-conductive state at the time t7 at which the image signal Data is kept at the voltage V2. This stores the charge according to the image signal Data into the capacitor 12, thereby writing the image signal voltage to the capacitor 12.

A period from the time t7 to the time t8 is for placing the transistor 16*b* in the complete non-conductive state.

A period after the time t8 is the emitting time period during which the light emitting element 10 emits light. By placing the transistor 16*d* into the conductive state, a current is supplied to the light emitting element 10 via the drive transistor 16*a*, according to the voltage (the data signal voltage) stored in the capacitor 12. This causes the light emitting element 10 to emit light.

Here, operation of the pixel circuit is described, which is performed when displaying different grayscales on adjacent rows, that is, when displaying different image signals Data on adjacent rows. For example, in order to display a window pattern in white at the center of a black screen, image signals Data according to black display are applied to the pixels on the 0th row of the window pattern, that is, one row followed by the 1st row which starts the display of window pattern, and image signals Data according to the white display are applied to the pixels on the 1st and the subsequent rows of the window pattern. Not limiting to the window pattern, in order to display a desired image on the display screen, image signals Vdata which are output during the vertical blanking period are applied to the pixels on the 0th row of the display screen, that is, the last row in the vertical blanking period, and image signals Data according to desired images to be displayed is applied to the pixels on the 1st and the following rows of the display screen. As such, different image signals Data are written to the 0th-row capacitor 12 and the 1st-row capacitor 12.

First, operation of a 1st-row pixel circuit in writing the image signal Data is described.

Figure 6:
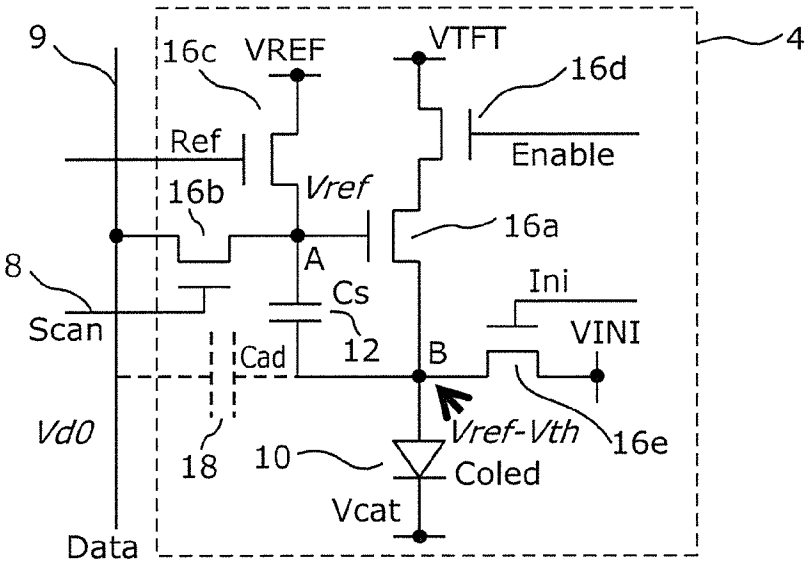
Figure 7A:
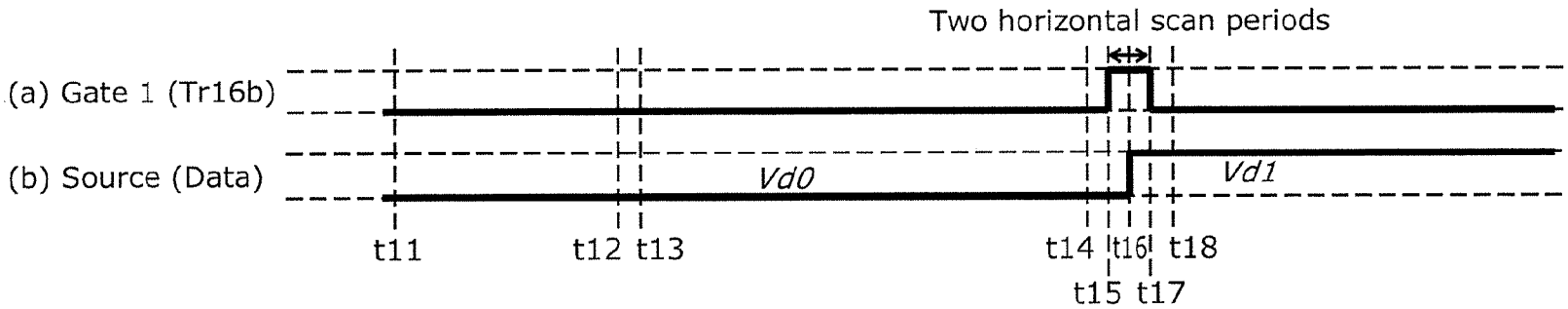
FIG. 7A is a timing diagram illustrating operation of a 1st-row pixel circuit.
Figure 7B:
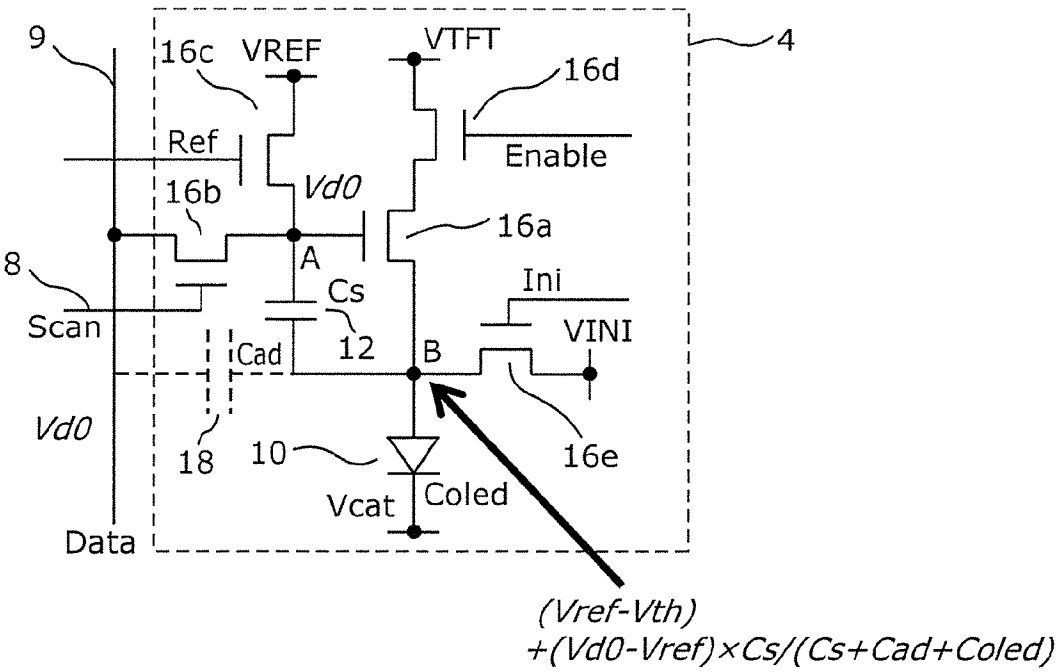
FIG. 7B is a circuit diagram for illustrating the operation of the 1st-row pixel circuit.
Figure 7C:
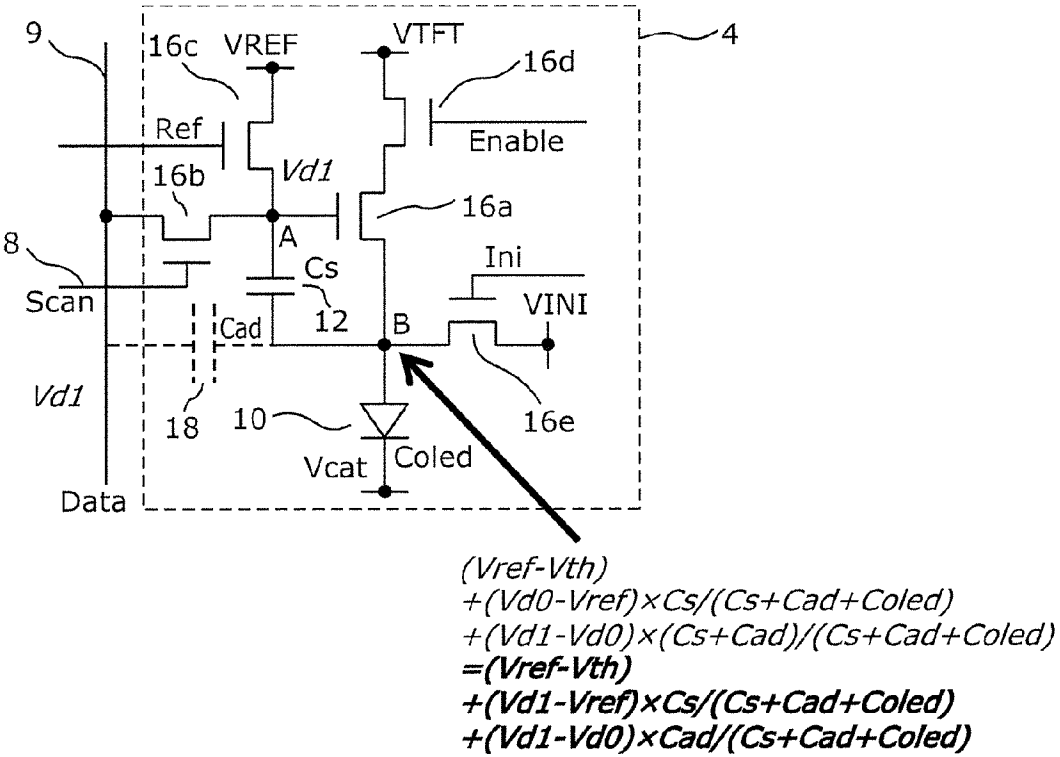
FIG. 7C is a circuit diagram for illustrating the operation of the 1st-row pixel circuit.
Figure 7D:
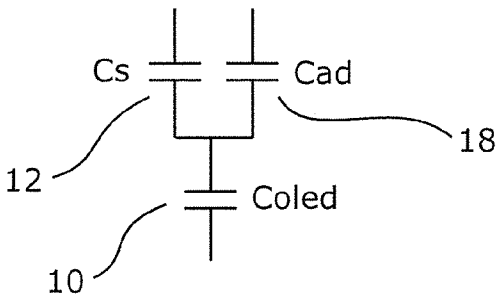
FIG. 7D is an equivalent circuit diagram showing connection of capacitors in the 1st-row pixel circuit.

FIG. 6 is a circuit diagram for illustrating operation of a pixel circuit before the image signal Data is written. FIG. 7A is a timing diagram illustrating operation of the 1st-row pixel circuit. FIGS. 7B and 7C are circuit diagrams for illustrating the operation of the 1st-row pixel circuit. FIG. 7D is an equivalent circuit diagram showing connection of capacitors existing in the 1st-row pixel circuit.

It should be noted that FIG. 7A illustrates only operation timing of the transistor 16*b* and a timing at which the image signal Data is applied to the pixel circuit, (a) of FIG. 7A showing the operation timing of the transistor 16*b*, (b) of FIG. 7A showing the timing at which the image signal Data is applied to the pixel circuit.

Here, a voltage according to an image signal Data to be displayed by a pixel on the 0th row is indicated by Vd0, and a voltage according to an image signal Data to be displayed by a pixel on the 1st row is indicated by Vd1. The capacitance of the capacitor 12 is indicated by Cs. The capacitance of the parasitic capacitance 18 is indicated by Cad. The capacitance of the light emitting element 10 is indicated by Coled.

In the pixel 4 prior to the writing of the image signal Data, as shown in FIG. 6, a voltage at the connection point A in the pixel 4 is represented by Vref and a voltage at a connection point B is represented by Vref minus Vth, where Vref denotes the reference voltage of the reference-voltage supply line VREF and Vth denotes the threshold voltage of the drive transistor 16*a*.

The operation of the 1st-row pixel 4 to write the image signal Data to be displayed by the 1st-row pixel 4, which is performed during a period from a time t11 to a time t14 and a period after a time t17 illustrated in FIG. 7A is the same as the operation performed by the pixel circuit in the period from the time t1 to the time t4 and the period after the time t7 illustrated in FIG. 5.

In FIG. 7A, a period from a time t15 to the time t17 is a writing time period during which an image signal voltage (a data signal voltage) according to a grayscale of display is taken from the signal line 9 into the circuit of the pixel 4 via the transistor 16*b*, and the image signal voltage is written to the capacitor 12.

At the time t15, the signal supplied to the transistor 16*b* changes from LOW to HIGH, thereby placing the transistor 16*b* in the conductive state. This changes the voltage applied to the connection point A in the pixel 4 to Vd0, as shown in FIG. 7B. The voltage applied to the connection point B in the pixel 4 is represented as follows:

$$(V\mathrm{ref}-V\mathrm{th})+(Vd0-V\mathrm{ref})\times Cs/(Cs+Cad+\mathrm{Coled})$$

Then, as the Data voltage changes from Vd0 to Vd1 at a time t16, as shown in FIG. 7C, the voltage applied to the connection point A in the pixel 4 changes to Vd1. In other words, the voltage applied between the gate and the source of the drive transistor 16*a* changes from Vd0 to Vd1.

At this time, the voltage applied to the source of the drive transistor 16*a* changes due to capacitive coupling of the capacitance Cs of the capacitor 12 and the capacitance Coled of the light emitting element 10. An amount of change of the voltage applied to the source of the drive transistor 16*a* depends on the magnitude of the capacitance Cad of the parasitic capacitance 18. The connection of the capacitance Cs of the capacitor 12, the capacitance Cad of the parasitic capacitance 18, and the capacitance Coled of the light emitting element 10 in this situation can be represented by the equivalent circuit shown in FIG. 7D. In other words, the connection is shown by a circuit structure in which the capacitance Cs of the capacitor 12 and the capacitance Cad of the parasitic capacitance 18 are connected in parallel and the capacitance Coled of the light emitting element 10 is connected in series therewith.

According to this circuit structure, the voltage applied to the connection point B in the pixel 4 is represented as follows:

$$(V\mathrm{ref}-V\mathrm{th})+(Vd0-V\mathrm{ref})\times Cs/(Cs+Cad+\mathrm{Coled})+(Vd1-Vd0)\times(Cs+Cad)/(Cs+Cad+\mathrm{Coled})=(V\mathrm{ref}-V\mathrm{th})+(Vd1\,V\mathrm{ref})\times Cs/(Cs+Cad+\mathrm{Coled})+(Vd1-Vd0)\times Cp/(Cs+Cad+\mathrm{Coled})$$

During a period from the time t16 to the time t17, the charge according to the Data voltage Vd1 is stored in the capacitor 12, thereby writing the Data voltage Vd1 to the capacitor 12. At this time, a gate-source voltage of the drive transistor 16*a* of the 1st-row pixel 4, that is, a voltage difference Vgs1 between the connection point A and the connection point B in the 1st-row pixel 4 is represented as follows:

$$Vgs1=(Vd1-V\mathrm{ref})\times(\mathrm{Coled}+Cad)/(Cs+Cad+\mathrm{Coled})-(Vd1-Vd0)\times Cad/(Cs+Cad+\mathrm{Coled})$$

In addition, at the time t17 at which the Data voltage is kept at Vd1, the signal supplied to the transistor 16*b* changes from HIGH to LOW, thereby placing the transistor 16*b* in the non-conductive state. After the time t17, the charge according to the Data voltage Vd1 is held in the capacitor 12.

Next, operation of a 2nd-row pixel circuit in writing the image signal Data is described.

Figure 8A:
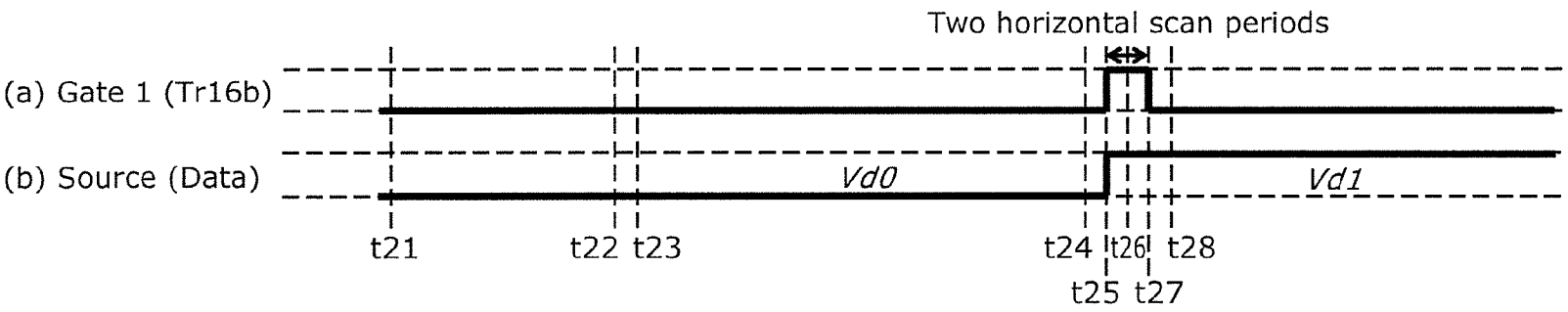
FIG. 8A is a timing diagram illustrating operation of a 2nd-row pixel circuit.
Figure 8B:
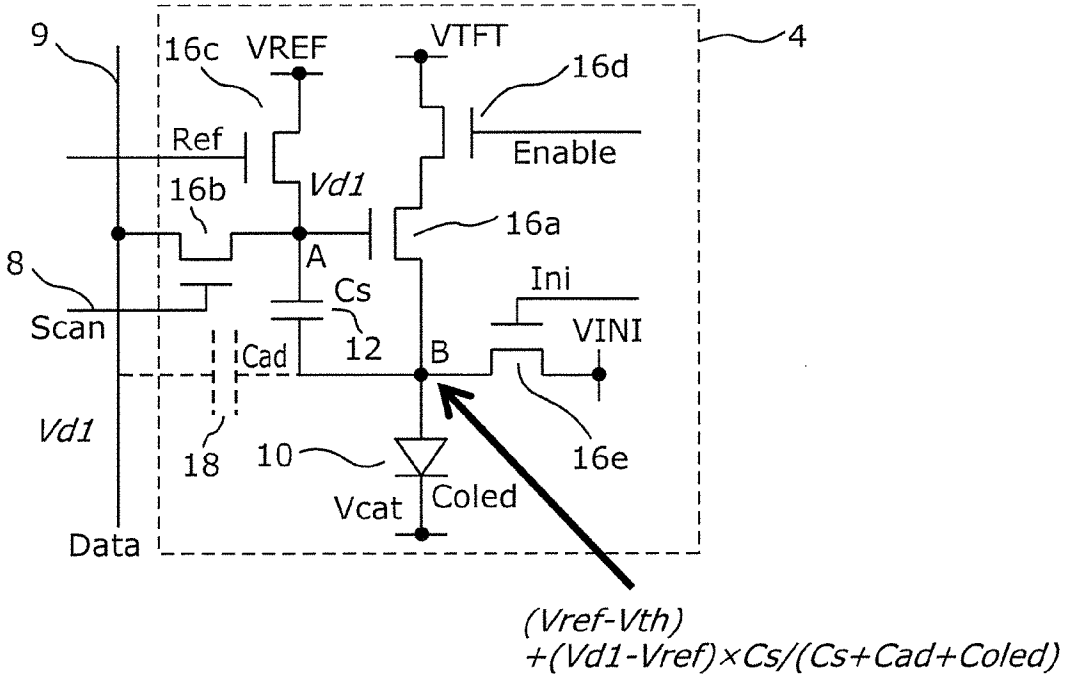
FIG. 8B is a circuit diagram for illustrating operation of a 2nd-row pixel circuit.
Figure 8C:
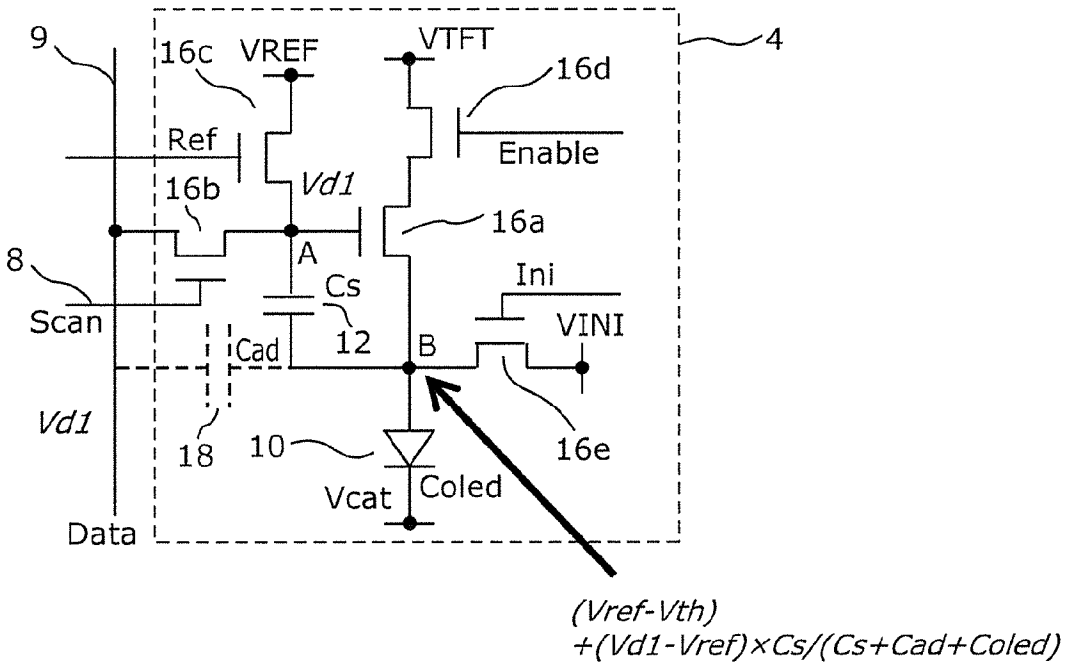
FIG. 8C is a circuit diagram for illustrating the operation of the 2nd-row pixel circuit.
Figure 8D:
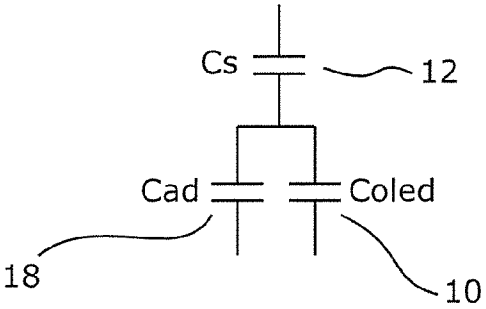
FIG. 8D is an equivalent circuit diagram showing connection of capacitors in the 2nd-row pixel circuit.

FIG. 8A is a timing diagram illustrating operation of the 2nd-row pixel circuit. FIGS. 8B and 8C are circuit diagrams for illustrating the operation of the 2nd-row pixel circuit. FIG. 8D is an equivalent circuit diagram showing connection of capacitors existing in the 2nd-row pixel circuit.

It should be noted that FIG. 8A illustrates only operation timing of the transistor 16*b* and a timing at which the image signal Data is applied to the pixel circuit, (a) of FIG. 8A showing the operation timing of the transistor 16*b*, (b) of FIG. 8A showing the timing at which the image signal Data is applied to the pixel circuit.

Here, the Data voltage according to the image signal Data to be displayed by the pixel on the 1st row is indicated by Vd1 as described above, and a Data voltage according to an image signal Data to be displayed by a pixel on the 2nd row is also indicated by Vd1.

In the pixel 4 prior to the writing of the image signal Data, as shown in FIG. 6, a voltage at the connection point A in the pixel 4 is represented by Vref and a voltage at a connection point B is represented by Vref minus Vth, where Vref denotes the reference voltage of the reference-voltage supply line VREF and Vth denotes the threshold voltage of the drive transistor 16*a*.

The operation of the 2nd-row pixel 4 to write the image signal Data to be displayed by the 2nd-row pixel 4, which is performed during a period from a time t21 to a time t24 and a period after a time t27 illustrated in FIG. 8A is the same as the operation performed by the pixel circuit in the period from the time t1 to the time t4 and the period after the time t7 illustrated in FIG. 5. A time t25 in FIG. 8A corresponds to the time t16 in FIG. 7A. In other words, the timing at which the Data voltage changes from Vd0 to Vd1 is the same as illustrated in FIG. 7A.

In FIG. 8C, a period from a time t25 to the time t27 is a writing time period during which an image signal voltage (a data signal voltage) according to grayscales of display is taken from the signal line 9 into the circuit of the pixel 4 via the transistor 16*b*, and the image signal voltage is written to the capacitor 12.

At the time t25, the signal supplied to the transistor 16*b* changes from LOW to HIGH, thereby placing the transistor 16*b* in the conductive state. Since the Data voltage changes from Vd0 to Vd1 at the time t25, the voltage applied to the connection point A in the pixel 4 changes to Vd1, as shown in FIG. 8B. The voltage applied to the connection point B in the pixel 4 is represented as follows:

$$(V\mathrm{ref}-V\mathrm{th})+(Vd1-V\mathrm{ref})\times Cs/(Cs+Cad+\mathrm{Coled})$$

As the Data voltage changes from Vd0 to Vd1 at the time t25 and the Data voltage is still kept at Vd1 at the time t26, the voltage applied to the connection point A in the pixel 4 is kept at Vd1 at the time t26, as shown in FIG. 8C. In other words, Vd1 is kept as the voltage which is applied between the gate and the source of the drive transistor 16*a*.

At this time, the voltage applied to the source of the drive transistor 16*a* is suppressed from varying, due to the parasitic capacitance 18. The connection of the capacitance Cs of the capacitor 12, the capacitance Cad of the parasitic capacitance 18, and the capacitance Coled of the light emitting element 10 in this situation can be represented by the equivalent circuit shown in FIG. 8D. In other words, the connection is shown by a circuit structure in which the capacitance Coled of the light emitting element 10 and the capacitance Cad of the parasitic capacitance 18 are connected in parallel and the capacitance Cs of the capacitor 12 is connected in series therewith.

Thus, the voltage applied to the connection point B in the pixels 4 is kept at (Vref−Vth)+(Vd1−Vref)×Cs/(Cs+Cad+Coled).

During a period from the time t26 to the time t27, the charge according to the Data voltage Vd1 is stored in the capacitor 12, thereby writing the Data voltage Vd1 to the capacitor 12. At this time, a gate-source voltage of the drive transistor 16*a* of the 2nd-row pixel 4, that is, a voltage difference Vgs2 between the connection point A and the connection point B in the 2nd-row pixel 4 is represented as follows:

$$Vgs2=(Vd1-V\mathrm{ref})\times(\mathrm{Coled}+Cad)/(Cs+Cad+\mathrm{Coled})$$

Thus, a difference Vgs1−Vgs2 between the gate-source voltage of the drive transistor 16*a* of the 1st-row pixel 4 and the gate-source voltage of the drive transistor 16*a* of the 2nd-row pixel 4 is represented as follows:

$$Vgs1-Vgs2=(Vd1-Vd0)\times Cad/(Cs+Cad+\mathrm{Coled})$$

In addition, at the time t27 at which the Data voltage is kept at Vd1, the signal supplied to the transistor 16*b* changes from HIGH to LOW, thereby placing the transistor 16*b* in the non-conductive state. After the time t27, the charge according to the Data voltage Vd1 is held in the capacitor 12.

The difference Vgs1−Vgs2 between the gate-source voltage of the drive transistor 16*a* of the 1st-row pixel 4 and the gate-source voltage of the drive transistor 16*a* of the 2nd-row pixel 4 is represented as follows:

$$Vgs1-Vgs2=\Delta V\mathrm{data}\times Cad/(Cs+Cad+\mathrm{Coled})$$

where ΔVdata (=Vd1−Vd0) denotes a difference between the Data voltage Vd0 (a first image signal) supplied to a 0th-row pixel 4 and the Data voltage Vd1 (a second image signal) supplied to the 1st-row pixel 4.

In other words, image display by the 1st-row pixel 4 has an error of the value represented by Vgs1−Vgs2=ΔVdata×Cad/(Cs+Cad+Coled), relative to image display by the 2nd-row pixel 4. Thus, by setting the value Vgs1−Vgs2=ΔVdata×Cad/(Cs+Cad+Coled) less than a voltage value of one grayscale, an image can be displayed at a normal luminance in the 1st-row pixel 4 even if images having different grayscales are displayed in the pixels 4 on the 0th and the 1st rows, that is, adjacent rows.

The value Vgs1−Vgs2=ΔVdata×Cad/(Cs+Cad+Coled) may be set by adjusting the voltage value to a value in a predetermined range. For example, if the amplitude of the gate-source voltage of the drive transistor 16*a* changes in a range from at least 0 V to at least 5 V in a display device of 1024 grayscale levels, the grayscale changes by one grayscale in response to the amplitude of the gate-source voltage of the drive transistor 16*a* changing by about 5 mV. Thus, the value Vgs1−Vgs2=ΔVdata×Cad/(Cs+Cad+Coled) may be set to a value less than 5 mV, for example. Specifically, the values Vd1 and Vd0 of the Data voltage are changed using the signal line driving circuit 7 such that the value Vgs1−Vgs2=ΔVdata×Cad/(Cs+Cad+Coled) is a value less than 5 mV.

Figure 9:
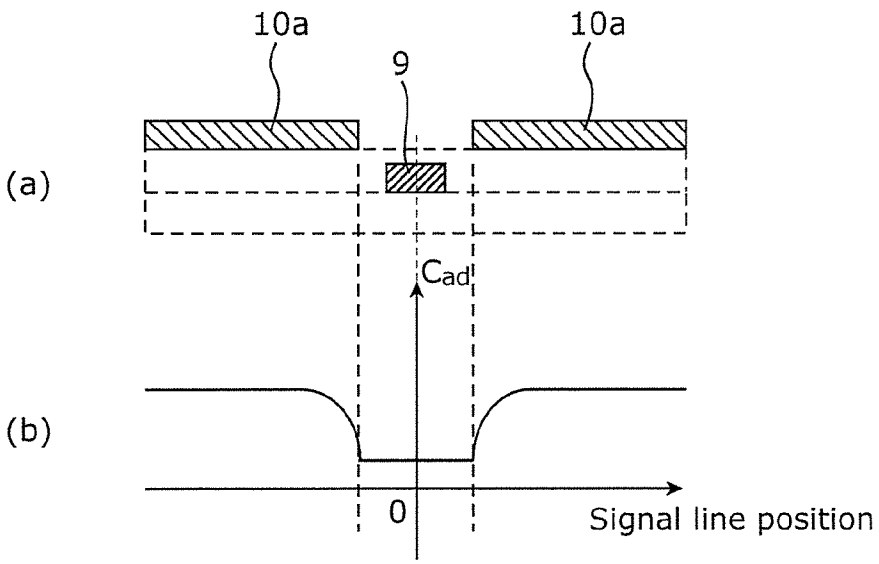
FIG. 9 is a diagram illustrating the relationship of the magnitude of parasitic capacitance versus the positional relationship of the signal line and the anode of the light emitting element according to Embodiment 1.

Alternatively, the value Vgs1−Vgs2=ΔVdata×Cad/(Cs+Cad+Coled) may be set to a voltage value less than one grayscale by arranging the positional relationship of the anode electrode 10*a* and the signal line 9. FIG. 9 is a diagram illustrating the relationship of the positional relationship of the anode electrode 10*a* of the light emitting element 10 and the signal line 9 versus the capacitance Cad of the parasitic capacitance 18, a sectional view of (a) showing the positional relationship of the anode electrode 10*a* of the light emitting element 10 and the signal line 9, (b) showing changes in capacitance Cad of the parasitic capacitance 18 in response to changes of the position of the signal line 9 relative to the position of the anode electrode 10*a*.

As shown in (a) of FIG. 9, the value of the capacitance Cad of the parasitic capacitance 18 is constant if the position of the signal line 9 does not overlap with the position of the anode electrode 10*a* in plan view, as shown in (b) of FIG. 9. If the signal line 9 overlaps with the anode electrode 10*a*, the value of the capacitance Cad of the parasitic capacitance 18 increases.

Thus, in order to achieve a reduced magnitude of the capacitance Cad of the parasitic capacitance 18, preferably, the signal line 9 and the anode electrode 10*a* do not overlap when viewed in plan. Setting the value of the capacitance Cad of the parasitic capacitance 18 to a small value achieves a reduced value $Vgs1-Vgs2=\Delta Vdata\times Cad/(Cs+Cad+Coled)$.

4. Effects

As described above, according to the display device of the present embodiment, in the case of a 0th-row pixel 4, a 1st-row pixel 4, and a 2nd-row pixel 4 which are connected to one of the signal lines 9 and supplied with a first image signal, a second image signal different from the first image signal, and the second image signal, respectively, image display by the 1st-row pixel 4 has an error of a value represented by $Vgs1-Vgs2=\Delta Vdata\times Cad/(Cs+Cad+Coled)$ relative to image display by the 2nd-row pixel 4. by setting the value $Vgs1-Vgs2=\Delta Vdata\times Cad/(Cs+Cad+Coled)$ less than a voltage value of one grayscale, an image can be displayed at a normal luminance in the 1st-row pixel 4 even if images having different grayscales are displayed in the pixels 4 on the 0th and the 1st rows, that is, adjacent rows.

It should be noted that the configuration of the pixels 4 is not limited to the above, and may be any other configuration. For example, the drive transistor 16*a* and the transistors 16*b* to 16*e* are not limited to n-type transistors, and may be p-type transistors. The timings at which the drive transistor 16*a* and the transistors 16*b* to 16*e* transition between the conductive state and the non-conductive state may be at any time insofar as the transistor 16*b* is placed in the conductive state before the image signal Data is supplied.

Embodiment 2

Figure 10:
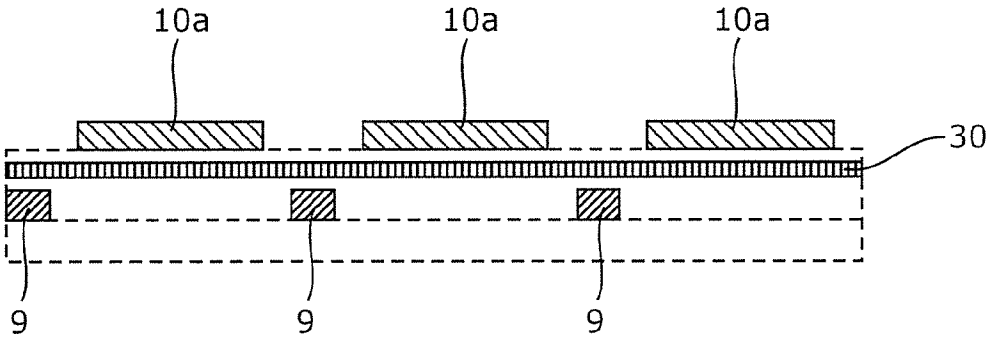
FIG. 10 is a sectional view showing the positional relationship of a signal line and an anode of a light emitting element according to Embodiment 2.

Next, Embodiment 2 is described. FIG. 10 is a sectional view showing the positional relationship of a signal line and an anode of a light emitting element according to Embodiment 2.

The display device according to the present embodiment is different from the display device 1 according to Embodiment 1 in that the display device according to the present embodiment includes a conductive layer 30 between an anode electrode 10*a* of a light emitting element 10 and a signal line 9.

As shown in FIG. 10, in the light emitting element 10, the anode electrode 10*a* of the light emitting element 10 and the signal line 9 are disposed in a manner that they do not overlap when the pixel 4 is viewed in plan, as with the positional relationship of the anode electrode 10*a* of the light emitting element 10 and the signal line 9 shown in FIGS. 3 and 4. Also as shown in FIG. 10, the anode electrode 10*a* and the signal lines 9 are disposed in two different layers. The conductive layer 30 is formed between a layer on which the signal line 9 is disposed and a layer on which the anode electrode 10*a* is disposed.

Since the conductive layer 30, which comprises, for example, a metal such as copper, is disposed between the anode electrode 10*a* and the signal line 9, the anode electrode 10*a* is prevented from the effect of changes of a Data voltage applied to the signal line 9, which obviates the need for consideration of parasitic capacitance between the anode electrode 10*a* and the signal lines 9.

Thus, an image in a 1st-row pixel 4 can be displayed at a normal luminance even if different grayscales are displayed in a pixel 4 on the 0th row and a pixel 4 on the 1st row, that is, adjacent rows.

It should be noted that the present disclosure is not limited to the embodiments described above, and various other modifications and variations can be devised without departing from the scope of the present disclosure.

For example, the drive transistor 16*a* and the transistors 16*b*, 16*c*, 16*d*, and 16*e* are not limited to n-type transistors and may be p-type transistors.

Moreover, the drive transistor 16*a* and the transistors 16*b* to 16*e* may transition between the conductive state and the non-conductive state at any time insofar as the transistor 16*b* is placed in the conductive state before the image signal Data is supplied.

Figure 11:
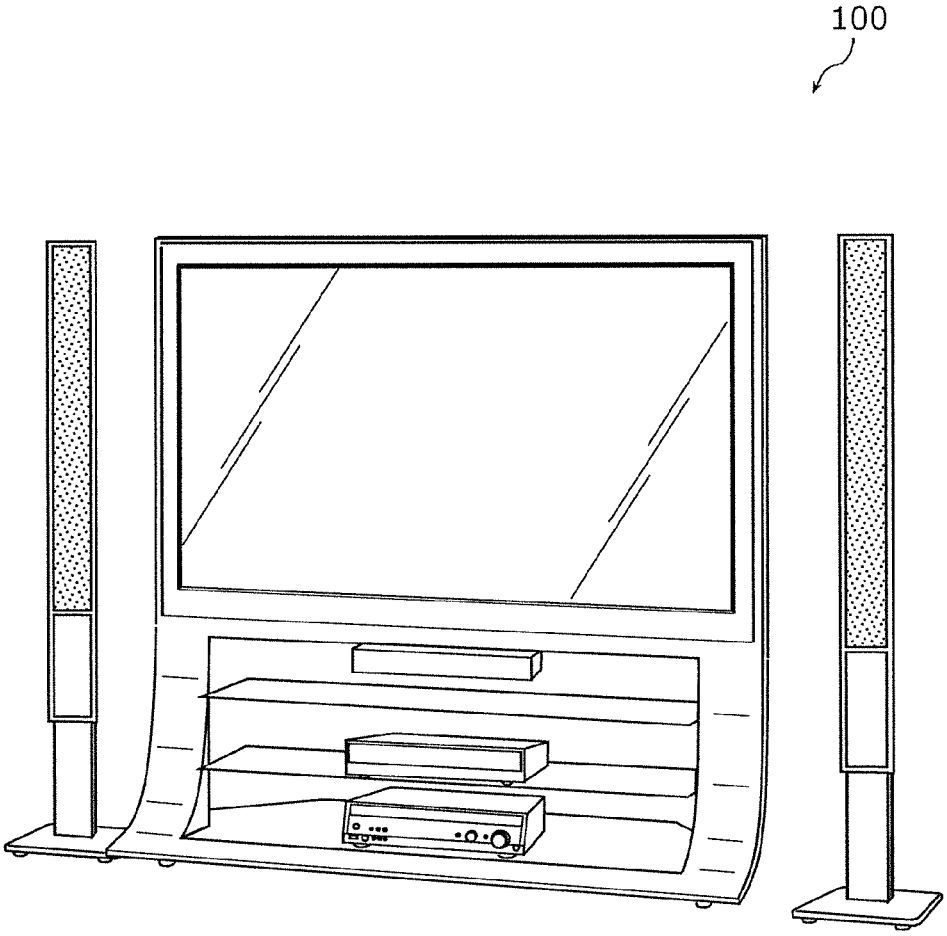
FIG. 11 is an external view of a television system which includes the display device according to Embodiments 1 and 2.

Moreover, a person skilled in the art will readily appreciate that various modifications are possible to the embodiments without departing from the spirit of the present disclosure. For example, a flat-screen television system 100 which includes the light emitting elements according to the present disclosure as shown in FIG. 11 is also included in the present disclosure.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

A display device according to the present disclosure is useful, particularly, in technical fields of displays of flat-screen televisions and personal computers which are demanded to be large screens and have high resolutions.

The invention claimed is:

1. A display device comprising:

a pixel region in which plural pixels, each including a light emitting element, a capacitor, a drive transistor, and a switch transistor, are arranged in rows and columns;

scanning lines which supply the plural pixels with control signals for controlling an on-state and an off-state of the switch transistor of each of the plural pixels;

signal lines which supply the plural pixels with image signals for causing the light emitting element of each of the plural pixels to emit light having a desired luminance; and parasitic capacitance which occurs between a source node of the light emitting element of each of the plural pixels and a signal line among the signal lines, wherein a 0th-row pixel, a 1st-row pixel, and a 2nd-row pixel included in the plural pixels are connected to the signal line and supplied with a first image signal, a second image signal different from the first image signal, and the second image signal, respectively, and a difference between a gate-source voltage of the drive transistor of the 1st-row pixel and a gate-source voltage of the drive transistor of the 2nd-row pixel is less than a voltage value of one grayscale, the difference being represented by:

$$\Delta V\text{data}\times_{Cad}/(Cs+Cad+\text{Coled})$$

where ΔVdata denotes a difference between the first image signal supplied to the 0th-row pixel and the second image signal supplied to the 1st-row pixel, Cs denotes capacitance of the capacitor, Cad denotes the parasitic capacitance, and Coled denotes capacitance of the light emitting element.

2. The display device according to claim 1, wherein the difference between the gate-source voltage of the drive transistor of the 1st-row pixel and the gate-source voltage of the drive transistor of the 2nd-row pixel is less than 5 mV and greater than 0 mV.

3. The display device according to claim 1, wherein an anode electrode of the light emitting element of each of the plural pixels and the signal lines do not overlap when the plural pixels are viewed in a plan view.

4. The display device according to claim 1, wherein a conductive layer is disposed between the anode electrode of the light emitting element of each of the plural pixels and the signal lines.

5. A method of operating a display device, the display device including a pixel region, scanning lines, and signal lines, the pixel region including plural pixels arranged in rows and columns, the plural pixels each including a light emitting element, a capacitor, a drive transistor, and a switch transistor, the scanning lines being for supplying the plural pixels with control signals for controlling an on-state and an off-state of the switch transistor of each of the plural pixels, the signal lines being for supplying the plural pixels with image signals for causing the light emitting element of each of the plural pixels to emit light having a desired, the method comprising:

supplying a 0th-row pixel included in the plural pixels with a first image signal via a signal line from among the signal lines during a first time period;

supplying a 1st-row pixel included in the plural pixels with a second image signal via the signal line during a second time period, the second image signal being different from the first image signal; and supplying a 2nd-row pixel included in the plural pixels with the second image signal via the signal line during a third time period, wherein parasitic capacitance occurs between a source node of the light emitting element of each of the plural pixels and the signal line among the signal lines, a difference between a gate-source voltage of the drive transistor of the 1st-row pixel and a gate-source voltage of the drive transistor of the 2nd-row pixel is less than a voltage value of one grayscale, the difference being represented by:

$$\Delta V\text{data}\times Cad/(Cs+Cad+\text{Coled})$$

where ΔVdata denotes a difference between the first image signal supplied to the 0th-row pixel and the second image signal supplied to the 1st-row pixel, Cs denotes capacitance of the capacitor, Cad denotes the parasitic capacitance, and Coled denotes capacitance of the light emitting element.

6. The method according to claim 5, wherein the difference between the gate-source voltage of the drive transistor of the 1st-row pixel and the gate-source voltage of the drive transistor of the 2nd-row pixel is less than 5 mV and greater than 0 mV.

7. The method according to claim 5, wherein an anode electrode of the light emitting element of each of the plural pixels and the signal lines do not overlap when the plural pixels are viewed in a plan view.

8. The method according to claim 5, wherein a conductive layer is disposed between the anode electrode of the light emitting element of each of the plural pixels and the signal lines.

* * * * *